US007455038B2

(12) United States Patent
Sic et al.

(10) Patent No.: US 7,455,038 B2
(45) Date of Patent: Nov. 25, 2008

(54) ROTARY MECHANICAL FIELD ASSEMBLY

(76) Inventors: Tihomir Sic, 24000 Subotica, Igmanska 14 (YU); Miladin Vidakovic, 24000 Subotica, Tamiska 18 (YU)

( * ) Notice: Subject to any disclaimer, the term of this patent is extended or adjusted under 35 U.S.C. 154(b) by 0 days.

(21) Appl. No.: 11/685,569

(22) Filed: Mar. 13, 2007

(65) Prior Publication Data

US 2007/0151529 A1 Jul. 5, 2007

Related U.S. Application Data

(63) Continuation-in-part of application No. 10/858,939, filed on Jun. 2, 2004, now Pat. No. 7,188,598.

(30) Foreign Application Priority Data

Apr. 7, 2004 (YU) ..... 292/04

(51) Int. Cl.
*F02B 75/32* (2006.01)
*F02B 75/22* (2006.01)
*F02D 19/10* (2006.01)

(52) U.S. Cl. ..... 123/55.5; 123/55.7; 123/27 R; 123/197.4

(58) Field of Classification Search ..... 123/229, 123/45 R, 27 R, 55.5, 55.7, 61 R, 63, 197.1, 123/197.4; 92/68, 138; 74/45, 47
See application file for complete search history.

(56) References Cited

U.S. PATENT DOCUMENTS 1,498,216 A * 6/1924 Wade ..... 123/55.7
1,513,310 A * 10/1924 Burtnett ..... 123/58.4
2,254,817 A * 9/1941 Blenker ..... 123/63
2,376,479 A * 5/1945 Fehling ..... 123/1 R
2,691,968 A * 10/1954 Barber ..... 123/301
2,917,031 A * 12/1959 Nestorovic ..... 123/299
3,996,901 A * 12/1976 Gale et al. ..... 123/242
4,308,843 A * 1/1982 Garretson ..... 123/525
4,407,239 A * 10/1983 Wass ..... 123/44 C
4,553,385 A * 11/1985 Lamont ..... 60/39.6
4,708,099 A * 11/1987 Ekker ..... 123/53.4
5,168,846 A * 12/1992 Paul et al. ..... 123/202
5,572,904 A * 11/1996 Minculescu ..... 123/55.7
6,941,903 B2 * 9/2005 Sic et al. ..... 123/46 R
7,188,598 B2 * 3/2007 Sič et al. ..... 123/197.4
7,210,446 B2 * 5/2007 Sic et al. ..... 123/197.4

* cited by examiner

*Primary Examiner*—Willis R Wolfe, Jr.
(74) *Attorney, Agent, or Firm*—Foley & Lardner LLP

(57) ABSTRACT

An engine is provided comprising a cylinder, a piston, a connecting rod, and a crank. A cylinder combustion occurs in the cylinder to induce movement of the piston in a lateral direction. The cylinder combustion comprises a first stage during which a first portion of a fuel and air mixture is burned over a substantially constant volume, and a second stage during which a second portion of the fuel and air mixture is burned over a substantially constant pressure. The piston comprises a piston head and a rigid piston rod mounted to the piston head. The connecting rod is pivotally mounted to the rigid piston rod and capable of receiving a pulling force applied by the piston. The crank is pivotally mounted to the connecting rod such that the connecting rod applies a torque capable of rotating the crank about a fixed axis as the piston moves within the cylinder.

18 Claims, 12 Drawing Sheets

ROTARY MECHANICAL FIELD ASSEMBLY

CROSS-REFERENCE TO RELATED APPLICATIONS

This application is a continuation in part of U.S. patent application Ser. No. 10/858,939, filed on Jun. 2, 2004 (now U.S. Pat. No. 7,188,598, granted Mar. 13, 2007), which claims priority to Yugoslavian Patent Application No. P-292/04, filed on Apr. 7, 2004.

FIELD

The present invention relates generally to internal combustion engines. More particularly, the present invention relates to a rotary mechanical field assembly in which linear force is transferred into rotational energy.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the claims in this application and is not admitted to be prior art by inclusion in this section.

An internal combustion engine creates force by burning fuel and air. In general, internal combustion engines or "engines" have two assemblies—the engine head and the engine block. The head of conventional engines typically includes an intake valve that opens and closes an intake port and an exhaust value that opens and closes an exhaust port. The block of conventional engines generally includes a crankshaft which is turned by a piston as the piston moves up and down in a cylinder that connects the engine head and block. In operation, the intake valve opens to allow a fuel and air mixture to enter an explosion chamber in the cylinder with a piston forming the floor of the chamber. An explosion of the fuel and air is created by a spark from a spark plug. This explosion causes the piston in the chamber to move downward and rotate the crankshaft in the engine block. The exhaust value opens and allows the exhaust from the explosion to escape as the piston returns to its position in the chamber before the explosion, helping to push the exhaust through the exhaust valve.

The block of the engine and the housing of the crankshaft are usually assembled in one casting. The camshaft, which operates the valves, can be located in the head or the block. In engines cooled with water, the head and the block of the engine have ducts for the cooling water. Generally, the pistons are connected by piston rods with the crankshaft that is rotating. The crankshaft has a fixed location to ensure uniformity of the rotation of the engine. The bottom of the engine at the lower end of the housing of the crankshaft serves for the placement of oil for lubrication.

Many different types of combustion engines have been developed. For example, an Otto engine utilizes a four-stroke approach (known as the Otto cycle in honor of Nikolaus Otto, who invented it in 1867). The Otto engine prepares fuel and air for burning outside of the cylinder using a carburetor, which mixes the correct amount of fuel and air. Another type of engine is a diesel engine (also named after its inventor, Rudolf Diesel). Diesel engines do not have spark plugs, rather a diesel engine compresses air and injects fuel into the compressed air. The heat of the compressed air lights the fuel spontaneously. A third type of engine is the Wankel engine or Wankel rotary engine (named after Felix Wankel). Instead of moving a piston up and down, the Wankel engine rotates a triangular rotor. The force to move the rotor comes from a combustion of fuel and air contained in a chamber formed by part of the housing and one face of the triangular rotor.

Modern engines can also be classified by how the fuel and air are provided and the exhaust is removed. A "four-stroke engine" has two valves for each cylinder—a suction valve and an exhaust valve. During the first stroke, the piston moves from an upper portion of the cylinder towards the bottom. The increased space in the cylinder (from the movement of the piston) creates a force that pushes the fuel and air mixture out of the carburetor into the explosion chamber. During the second stroke, the piston moves from the bottom portion of the cylinder towards the top. The piston compresses the fuel and air mixture in the cylinder because the valves are closed. In the third stroke, the mixture is ignited by a spark in the spark plug. The mixture burns, increasing the temperature and the pressure. This pressure from the burning process pushes the piston from the upper to the lower portion of the cylinder, exerting a force to rotate the crankshaft. In the fourth stroke, the burned gases are exhausted out through an opened exhaust valve. The piston moves from the bottom towards the upper portion of the cylinder, pushing the remnants of burned gasses from the cylinder. The process then repeats itself.

In a "two-stroke engine," the filling and emptying of the cylinder happens during one part of the rotation of the crankshaft. Instead of suction and exhaust valves, the two-stroke engine has openings on the cylinder liner which are closed and opened by movement of the piston. Typically, the exhaust opening is located closer to the top of the cylinder than the intake opening. When the piston is moving up it creates pressure to push exhaust out the exhaust opening. Before the piston reaches the top of its movement in the cylinder, it covers over the exhaust creating pressure in the explosion chamber for the combustion to occur. When the piston is moving down, it uncovers the intake opening and acts as a pump to move the fuel and air mixture into the chamber.

Engines can also be categorized according to the position of the cylinders. Examples of engines with cylinders located in different positions are sequence or "in-line" engines, V-engines, rotation engines, and boxer engines. Sequence engine cylinders are placed one cylinder after another in a row. As a result, working strokes overlap, ensuring uniformity in the drive of the crankshaft. V-engine cylinders are placed in two lines set at an angle to each other. Thus, crankshafts for V-engines can be shorter than those for sequence engines. As discussed above, rotation engines, like the Wankel engine, do not have pistons that move in up-and-down fashion; rather the pistons are rotors formed in the shape of a triangle. In the first stroke of a rotation engine, the rotor rotates to open the intake opening, which allows a fuel and air mixture to enter a chamber. As the rotor rotates in a second stroke, the volume of the chamber decreases and the mixture is compressed. In a third stroke, a spark from the spark plug ignites the mixture. Burned gasses are spread and set the rotor in motion. The volume of the chamber again increases. In a fourth stroke, the first gasket of the chamber slides ahead along the exhaustion opening, opening it for the burned gasses to escape.

Boxer engine cylinders are flat in that they are located 180 degrees from each other. The crankshaft can be shorter than the crankshaft of the sequence engine, and in four cylinder engines, boxer engines only need three standing bearings. In a boxer engine with four cylinders, there is ignition on each half rotation of the crankshaft. Boxer engines are characterized by uniform flow of the rotary momentum, enabling a quiet workflow, because movement on one side of the engine levels with the movement on the other side.

Despite various advancements that have been made heretofore in engine technology, it would be desirable to improve conventional engines, such as the engines described above. For example, it would be desirable to reduce the sound volume produced by engines and to reduce the consumption of fuel needed. Moreover, it would be desirable to produce high power engines with a wide range of uses. Yet still further, it would be desirable to increase the engine's power and momentum.

SUMMARY

In general, exemplary embodiments described herein relate to a rotary mechanical field assembly in which linear force is transferred to rotational energy. An exemplary embodiment relates to an engine having a rotary member and a linear member. The rotary member includes a first axis about which the rotary member rotates and a second axis coupling the rotary member to an offset rotary element. The linear member is coupled to the offset rotary element by a first coupling fixed in position relative to the linear member and a second coupling that moves within a space in the linear member. The linear member moves back and forth in lateral fashion from a first position to a second position. The lateral movement of the linear member causes continuous rotational movement of the rotary member in one direction.

Another exemplary embodiment relates to a connection that couples linearly moving objects to circularly moving objects. The connection includes a fixed connector coupling a linearly moving object to a circularly moving object at a first distance from an axis of the circularly moving object and a rotating connector including a cross bar that moves in a space within the linearly moving object. The cross bar is located on the rotating connector a second distance from an axle of the rotating connector and the axle is rotatably coupled to the axis of the circularly moving object.

Another exemplary embodiment relates to a piston that provides linear motion which is converted to rotational motion. The piston includes a first end, a second end distal to the first end, a fixed connection point between the first and second ends coupling a fixed coupling to a offset rotary element rotatably connected to a rotary element, and a non-fixed connection space between the fixed connection point and the second end. The non-fixed connection space is configured to receive a movable coupling to the offset rotary element. The movable coupling and fixed coupling coordinate to rotate the offset rotary element and the rotary element as the movable coupling moves in a linear direction in the non-fixed connection space.

Another exemplary embodiment relates to an assembly that converts linear motion to rotational motion. The assembly includes a linear component that moves in a first linear direction when acted upon by a first force and in a second linear direction when acted upon by a second force. The first linear direction is opposite to the second linear direction. The assembly also includes a rotary component that moves in a rotary direction when the linear component moves. The rotary component includes an offset rotary element rotatably connected to the rotary component. The offset rotary element is coupled to the linear component by a fixed connection and a moveable connection. The moveable connection to the linear component is contained in an aperture in the linear component and moves within the aperture in the linear component as to cause the offset rotary element and the rotary component to move in a continuous rotary direction despite a change in direction by the linear component from the first linear direction to the second linear direction.

Yet another exemplary embodiment relates to a system for transferring linear motion into rotational motion. The system includes a piston moving linearly between two power sources and a wheel having a rotating disc rotatably connected to one side of the wheel. The rotating disc is coupled to the piston by a fixed connection and a moveable connection that moves within an aperture section of the piston when the piston moves, such that the rotating disc moves as a result of the fixed connection and the movement of the moveable connection, and the movement of the rotating disc causes the wheel to rotate.

Further still, another exemplary embodiment relates to an engine comprising a cylinder, a piston, a connecting rod, and a crank. A cylinder combustion occurs in the cylinder to induce movement of the piston in a lateral direction. The cylinder combustion comprises a first stage during which a first portion of a fuel and air mixture is burned over a substantially constant volume, and a second stage during which a second portion of the fuel and air mixture is burned over a substantially constant pressure. The piston comprises a piston head and a rigid piston rod mounted to the piston head. The connecting rod is pivotally mounted to the rigid piston rod and capable of receiving a pulling force applied by the piston. The crank is pivotally mounted to the connecting rod such that the connecting rod applies a torque capable of rotating the crank about a fixed axis as the piston moves within the cylinder.

Another exemplary embodiment relates to a method of generating work with a rotary field mechanical engine. The method comprises causing a piston head to perform an intake stroke in a first lateral direction such that a fuel and air mixture is injected into a cylinder in which the piston head moves. The method further comprises causing the piston head to perform a compression stroke in a second lateral direction which is opposite the first lateral direction such that the injected fuel and air mixture is compressed over a substantially constant pressure within the cylinder. The method also comprises igniting the compressed fuel and air mixture such that a first combustion reaction and a second combustion reaction occur. The first combustion reaction causes a first portion of the fuel and air mixture to burn while a volume of the fuel and air mixture remains substantially constant. The second combustion reaction causes a second portion of the fuel and air mixture to burn while a pressure within the cylinder remains substantially constant. The piston head moves in the first lateral direction during the second combustion reaction.

DETAILED DESCRIPTION OF EXEMPLARY EMBODIMENTS

Figure 1:
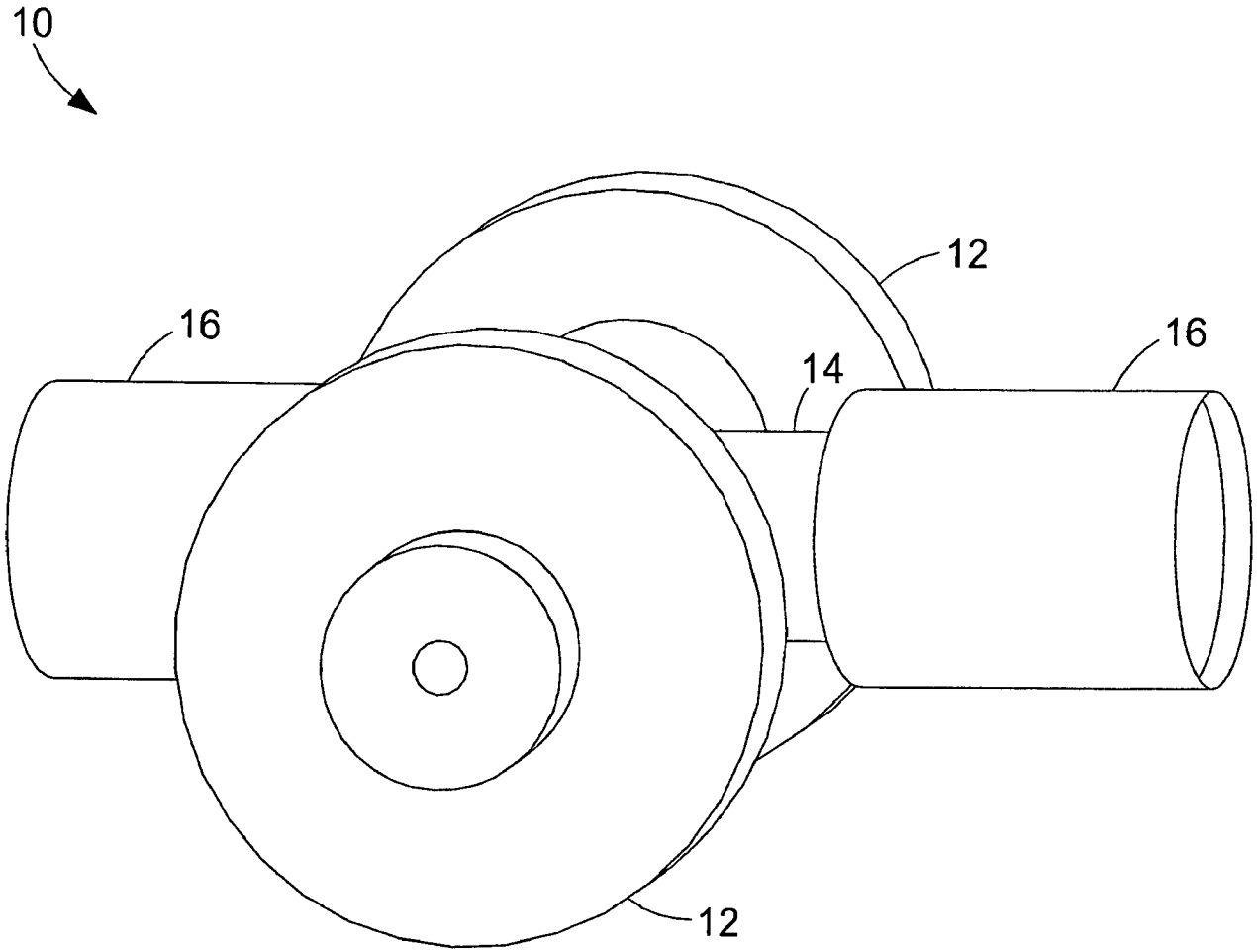
FIG. 1 is a general perspective view diagram of an engine in accordance with an exemplary embodiment.
Figure 2:
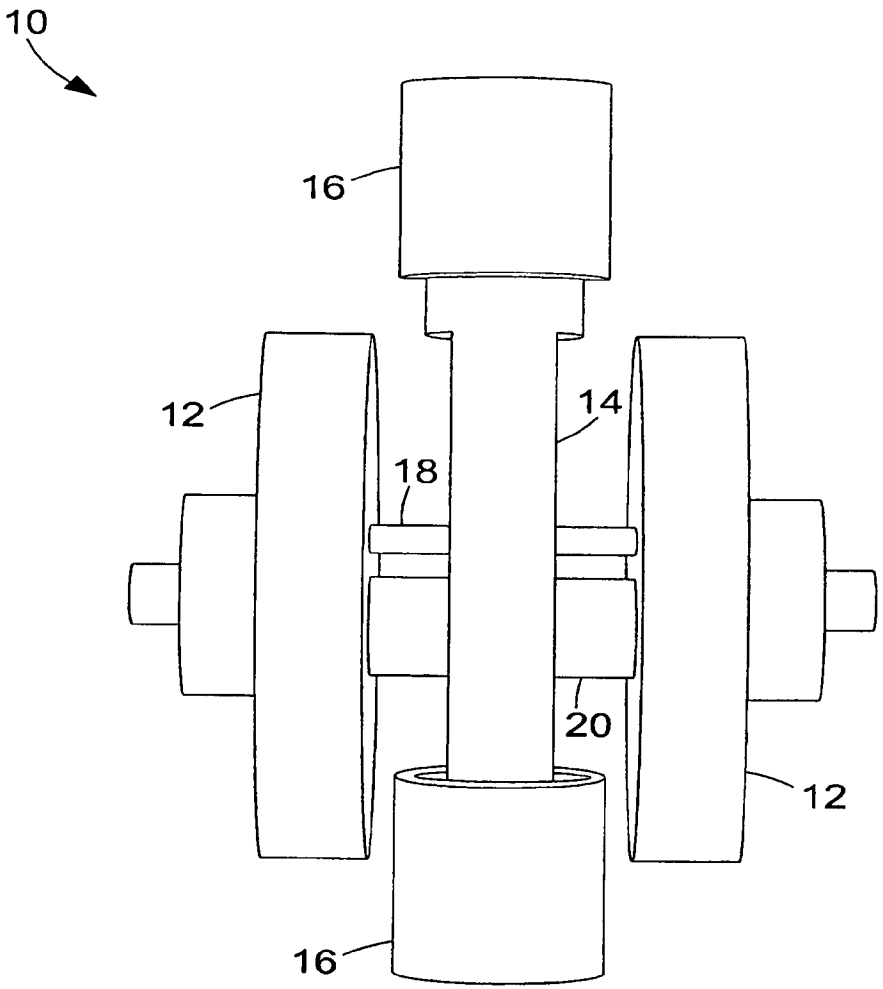
FIG. 2 is a general top view diagram of the engine of FIG. 1.

FIG. 1 illustrates a portion 10 of an engine having rotary members 12, a piston 14, and cylinder heads 16. The piston 14 is located between rotary members 12. The cylinder heads 16 are located at distal ends of the piston 14. The cylinder heads 16 can include engine head components, such as a carburetor, intake valve, exhaust valve, and other components described in the discussion of the related art above. As shown in FIG. 2, the rotary members 12 are coupled to the piston 14 by a connector 18 and a connector 20.

In operation, combustion of fuel and air occurs in one of the cylinder heads 16. This combustion creates a force on the piston 14 to move it laterally towards the other one of the cylinder heads 16. A combustion of fuel and air occurs in the other one of the cylinder heads 16 and forces the piston 14 back toward the original one of the cylinder heads 16. The timing of the combustions at either end of the piston 14 can be coordinated by a timing circuit. As a result of timed ignitions in the cylinder heads 16, the piston 14 is moved laterally back and forth. This lateral movement of the piston 14 is translated into rotary motion of the rotary members 12 connected by the piston 14 by connectors 18 and 20.

Figure 4:
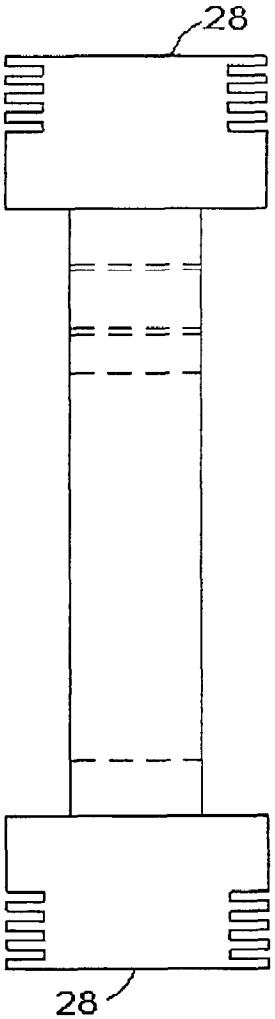
FIG. 4 is a top view diagram of the piston of FIG. 3.
Figure 3:
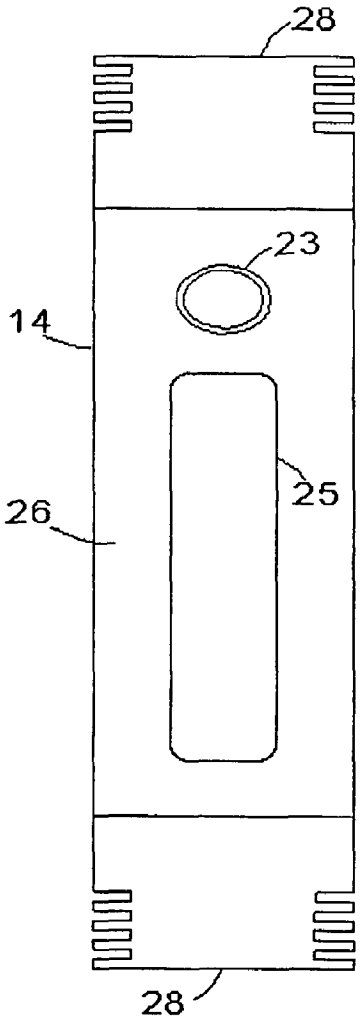
FIG. 3 is a side view diagram of a piston used in the engine of FIG. 1.

FIG. 3 is a side view diagram of the piston 14 used in the engine of FIG. 1. FIG. 4 is a top view diagram of the piston of FIG. 3. The piston 14 can include a circular aperture 23 and a rectangular aperture 25. The connector 18 coupling the piston 14 and the rotary members 12 is located in a fixed position within the circular aperture 23. The connector 20 that also couples the piston 14 and the rotary members 12 is located within the rectangular aperture 25. The portion of connector 20 located within the rectangular aperture 25 is not in a fixed position. As shown in FIG. 4, in one embodiment, the piston 14 has a flat section 26 and cylindrical sections 28. The cylindrical sections 28 are configured to fit within the cylinder heads 16 described with reference to FIGS. 1 and 2. Other configurations of the piston 14 can also be utilized.

Figure 5:
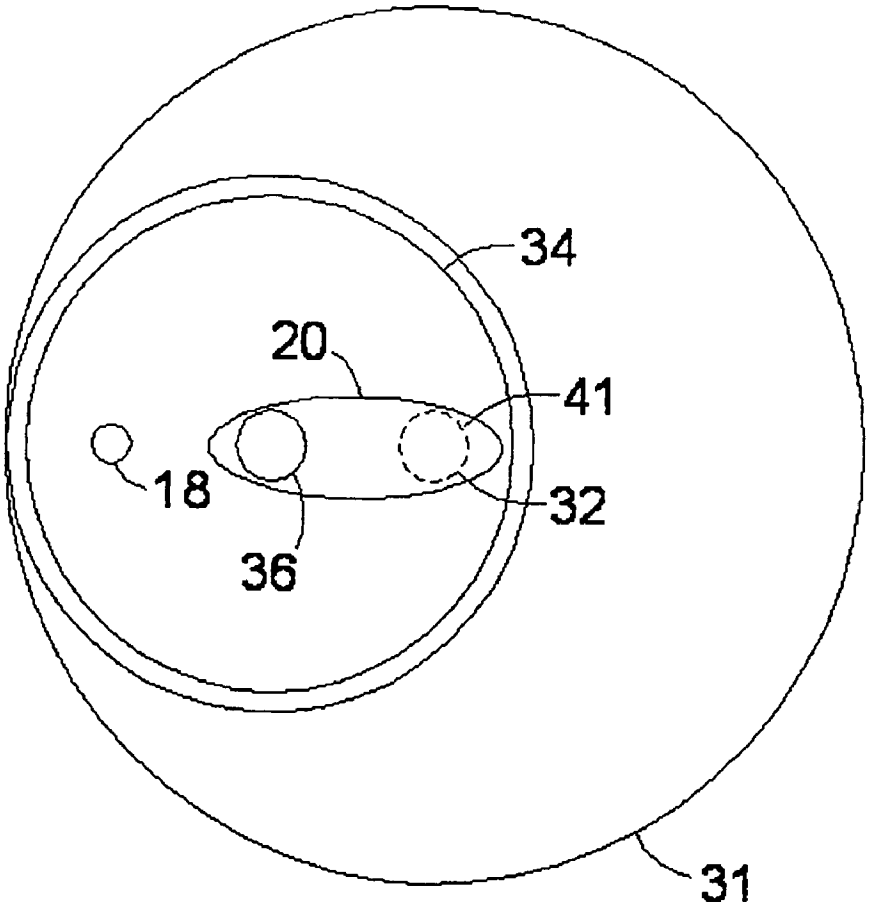
FIG. 5 is a side view diagram of a rotary member of the engine of FIG. 1.

FIG. 5 illustrates a rotary member assembly providing details of the construction of the rotary members 12 according to an exemplary embodiment. The rotary member assembly includes a main disc 31, a first axis 32, and an inset disc 34 which is offset from the first axis 32. The inset disc 34 is positioned in a cut out section of the main disc 31 and rotates about a second axis 36. In an alternative embodiment, the inset disc 34 is not inside a cut out of the main disc 31 but is coupled to the surface of the main disc 31. The embodiment with the inset disc 34 is generally preferred to achieve a balance of masses in the assembly. The connector 18 shown in FIGS. 1 and 2 coupling the piston 14 to the rotary members 12 is attached to the inset disc 34 at a distance from the axis of the inset disc 34 (second axis 36). The connector 20 shown in FIGS. 1 and 2 passes through the rectangular aperture 25 of the piston 14 and attaches to the inset disc 34 at the second axis 36. The connector 20 includes a cross bar 41 described with reference to FIGS. 10-12. The cross bar 41 is located in the same plane as the axis of the main disc 31.

Figure 8:
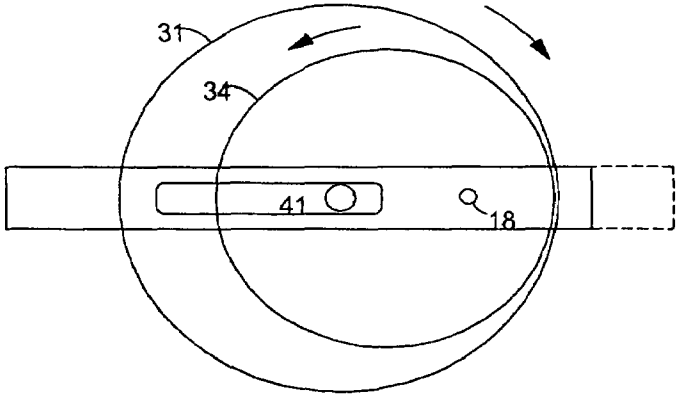
FIG. 8 is a cut-out side view diagram of the piston and rotary member of the engine of FIG. 1 at a third position.
Figure 9:
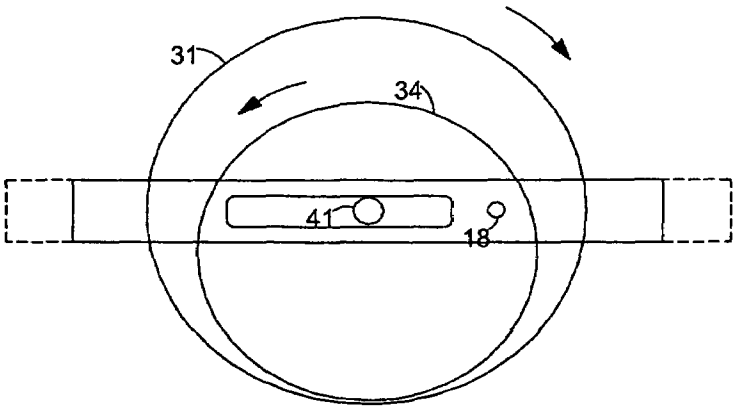
FIG. 9 is a cut-out side view diagram of the piston and rotary member of the engine of FIG. 1 at a fourth position.
Figure 6:
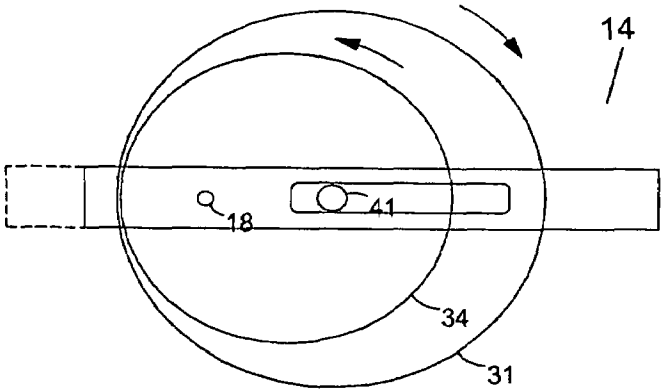
FIG. 6 is a cut-out side view diagram of the piston and rotary member of the engine of FIG. 1 at a first position.
Figure 7:
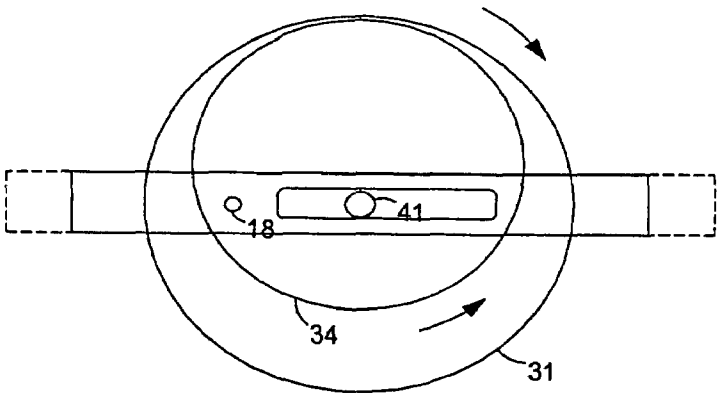
FIG. 7 is a cut-out side view diagram of the piston and rotary member of the engine of FIG. 1 at a second position.

FIGS. 6-9 illustrate the movement of the rotary member assembly as the piston 14 moves. In FIG. 6, the piston 14 is at its right-most position, which is the point at which a fuel and air explosion is created from a spark in the right cylinder, forcing the piston 14 toward the left. The inset disc 34 is positioned on the left of the main disc 31 with respect to the piston 14. In FIG. 7, the piston 14 is located at a middle point. The main disc 31 has moved in a clock-wise direction while the inset disc 34 has moved in a counter-clock wise direction. The inset disc 34 is positioned at the top of the main disc 31 with respect to the piston 14. In FIG. 8, the piston 14 is at its left-most position, which is the point at which a fuel and air explosion is created from a spark in the right cylinder, forcing the piston 14 toward the right. The inset disc 34 is positioned on the right of the main disc 31 with respect to the piston 14. In FIG. 9, the piston 14 is located at a middle point. The main disc 31 moves in a clock-wise direction while the inset disc 34 continues to move in a counter-clock wise direction. The inset disc 34 is positioned at the bottom of the main disc 31 with respect to the piston 14. The rotary member assembly continues to move in this fashion as the piston 14 moves laterally back and forth between the two cylinders heads 16.

Figure 10:
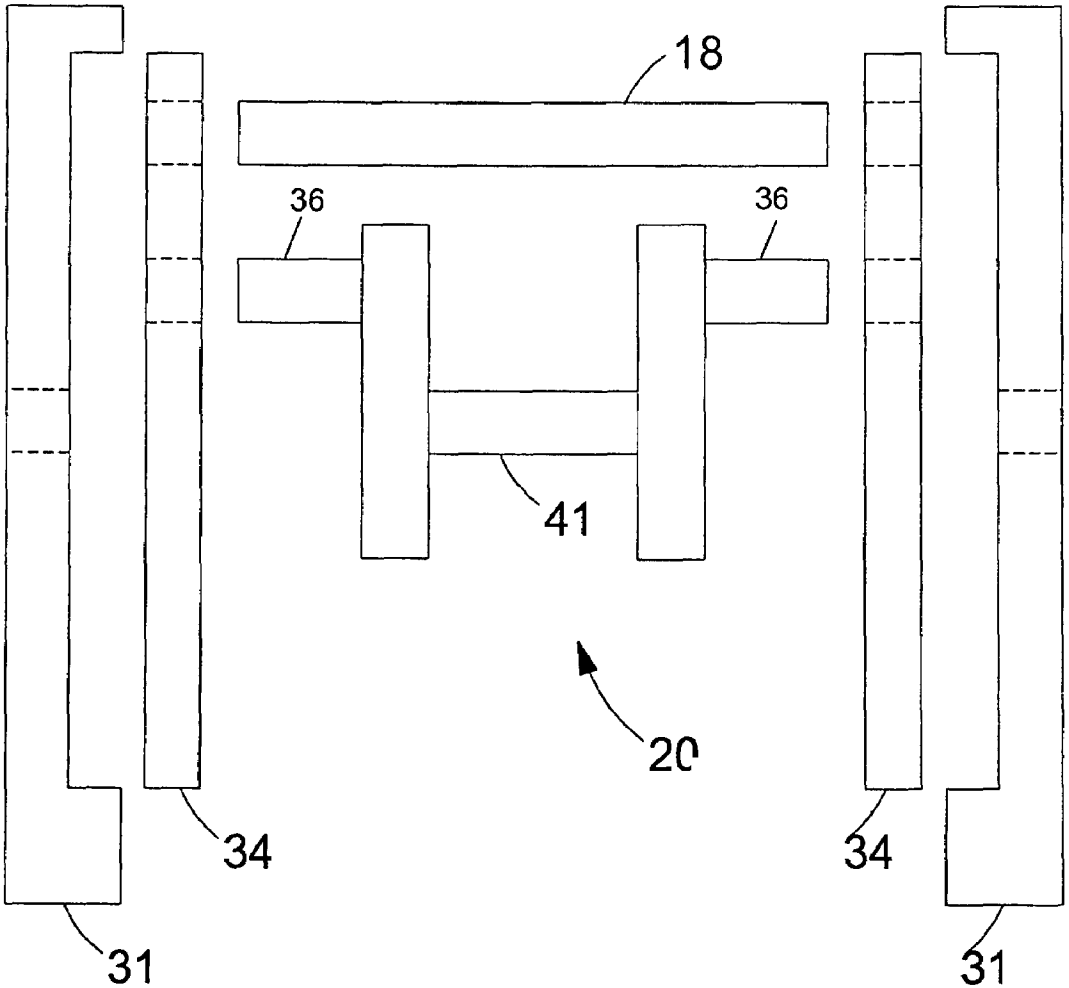
FIG. 10 is an exploded side view of the rotary member of the engine of FIG. 1.
Figure 12:
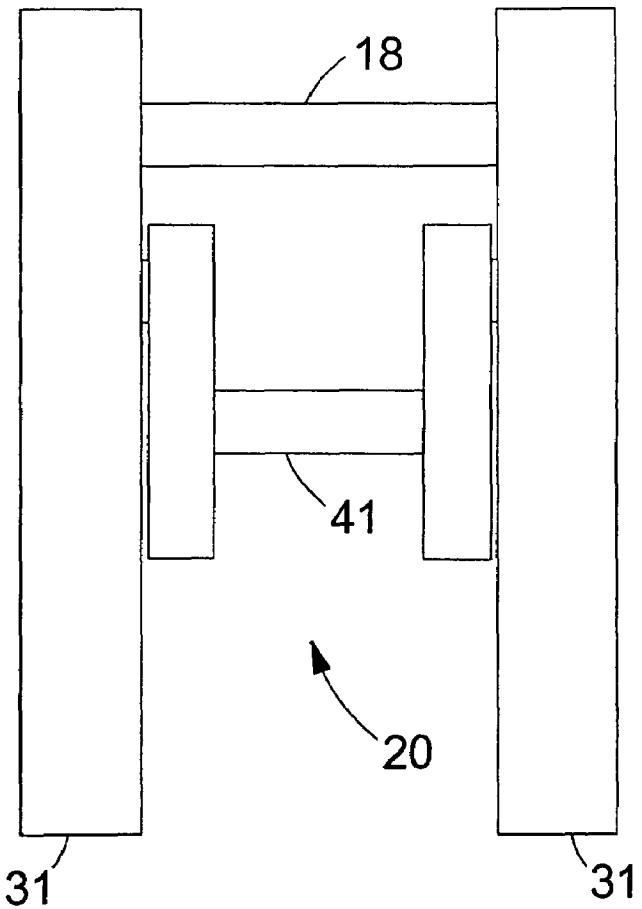
FIG. 12 is a side view of the rotary member of the engine of FIG. 1.
Figure 11:
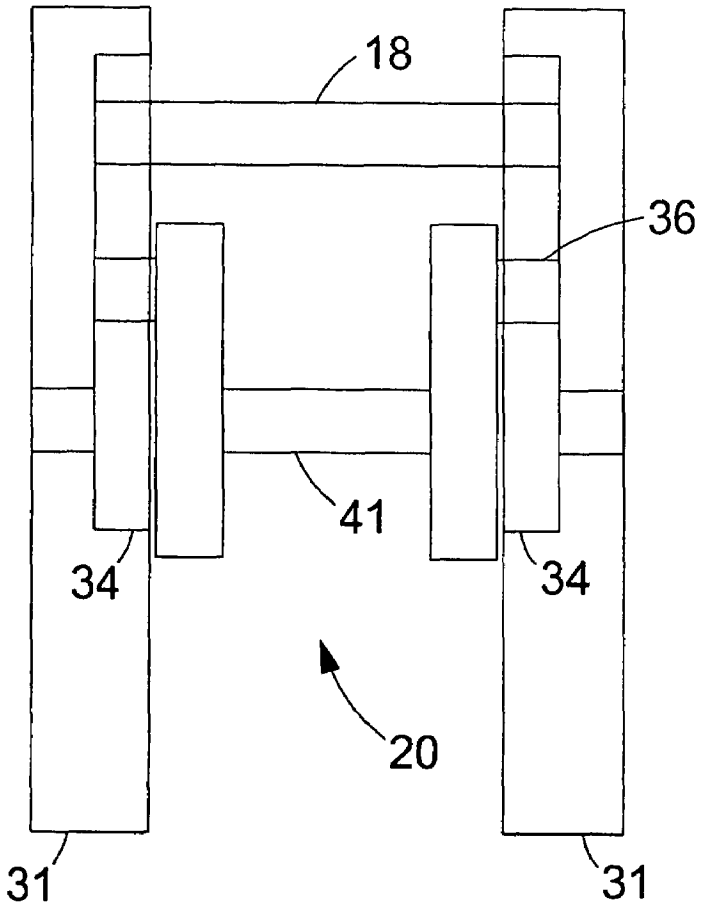
FIG. 11 is a cut-out side view of the rotary member of the engine of FIG. 1.

FIG. 10 illustrates an exploded view of the rotary member assembly described with reference to FIG. 5, showing the main disc 31, inset disc 34, connectors 18 and 20, and second axis 36. The connector 20 includes a cross bar 41 that rotates about the second axis 36 but within the rectangular aperture 25 of the piston 14 described with reference to FIG. 3. FIG. 11 shows a cut-out view of the rotary member assembly, and FIG. 12 shows a side view of the rotary member assembly including the connectors 18 and 20.

Figures 13, 14, 15:
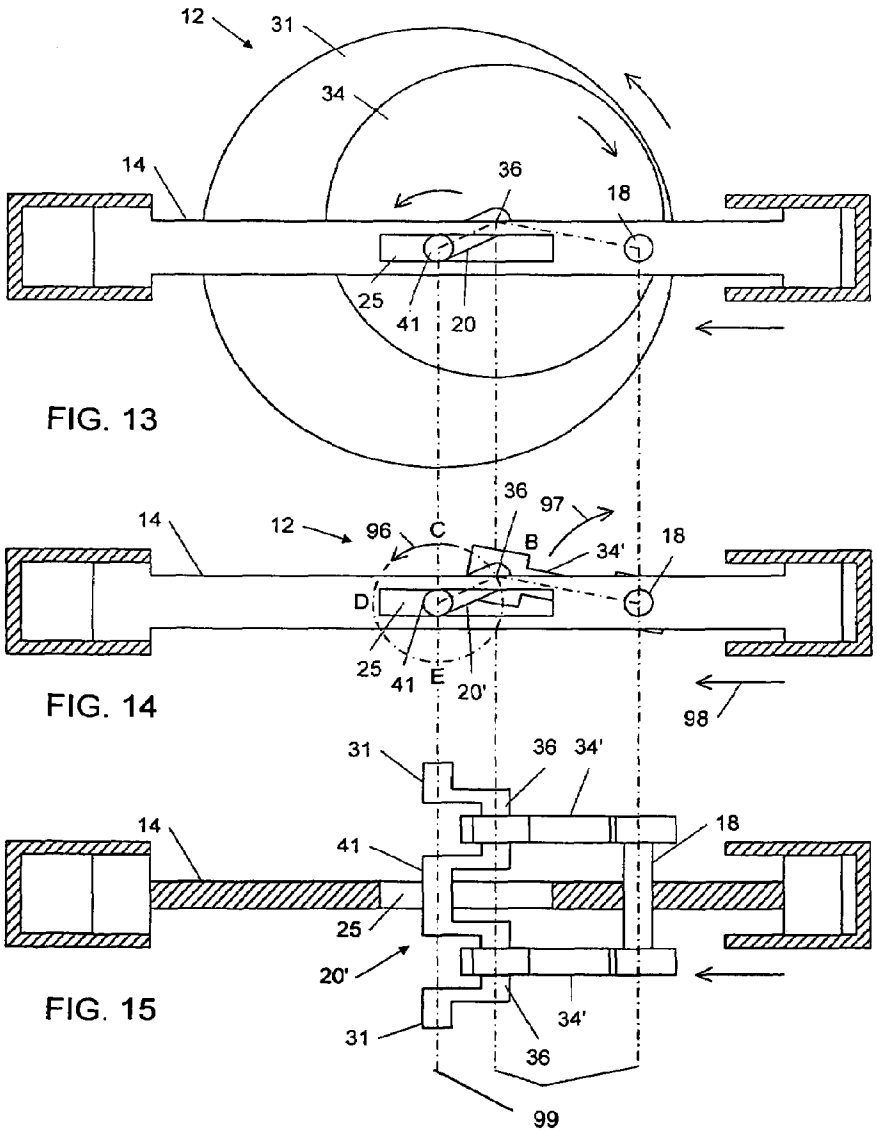
FIG. 13 is a side view of the rotary member of the engine of FIG. 1.
FIG. 14 is a sectional side view of the rotary member of FIG. 13.
FIG. 15 is a sectional top view of the rotary member of FIG. 13.

FIGS. 13-15 further illustrate the operation and movement of portion 10 described with reference to FIGS. 1-12. FIG. 13 shows a side view diagram of the rotary member assembly described with reference to FIGS. 6-9. FIG. 14 illustrates a sectional side view of the rotary member assembly of FIG. 13. FIG. 15 illustrates a sectional top view of the rotary member assembly of FIG. 13. The rotary member assembly shown in FIGS. 14 and 15 is mechanically equivalent to the rotary members 12 shown in FIG. 13.

The dashed centerlines 99 show how the views in FIGS. 14 and 15 relate to the exemplary embodiment in FIG. 13. For example, the inset disc 34 in FIG. 13 is equivalent to rods 34' in FIGS. 14 and 15. The centerlines 99 that trace through the connector 18 and the second axis 36 show that the inset disc 34 and the rods 34' are mechanically equivalent. Likewise, the connector 20 is the mechanical equivalent of a crank 20'.

In FIG. 14, the rotary member assembly includes the crank 20', rods 34', the connector 18, and the piston 14. The connector 18, shown in FIGS. 14 and 15, coupling the piston 14 to the rotary members 12 is attached to the rods 34' at a distance from second axis 36. The rods 34' rotate about the connector 18. The crank 20', shown in FIGS. 14 and 15, passes through the rectangular aperture 25 of the piston 14 and attaches to the rods 34' at the second axis 36. The crank 20' includes a cross bar 41 described with reference to FIGS. 14 and 15.

The motion of the rotary members of FIGS. 13-15 is now described. In FIGS. 14 and 15, the piston 14 is near its right-most position. Assuming that the piston has just begun a power stroke (of a four stroke cycle) relative to the right cylinder, the piston 14 is traveling towards the left; the second axis 36 is at point B in FIG. 14. As the piston 14 moves left (shown by arrow 98), the rods 34' are forced to rotate clockwise about connector 18 (shown by arrow 97) towards point C. The clockwise motion of rods 34' causes crank 20' to rotate counter-clockwise (shown by arrow 96). When the second axis 36 reaches point C, the force of the power stroke on piston 14 and the mechanical restriction of crank 20' cause rods 34' to rotate counter-clockwise towards point D. When the power stroke is completed, the piston 14 has reached its left-most limit and an exhaust stroke begins relative to the right chamber. The rods 34' have also traveled to their left-most limit; the second axis 36 is at point D. The momentum of the system causes the rods 34' to continue to rotate counter-clockwise; the second axis 36 moves towards point E. The crank 20' also rotates counter-clockwise. The piston 14 moves towards the right. When the second axis 36 reaches point E, the rods 34' begin to rotate clockwise while the crank 20' continues to rotate counter-clockwise. When the piston 14 has reached its right-most limit (back to point B), the rotary members 12 have completed two cycles. The rotary member assembly continues to move in this fashion as the piston 14 moves laterally back and forth between the two cylinders heads 16.

The rotary mechanical field engines described herein have numerous advantages over traditional engines. As an example, given the same input work, a rotary mechanical field engine is capable of producing significantly more output work than a traditional engine. As described in more detail below, this allows the rotary mechanical field engine to operate at a slower speed, resulting in an optimized combustion cycle. In the context of an engine, an amount of work performed by the piston can be an input work $W_P$ which causes the rest of the engine to operate. The input work $W_P$ performed by the piston can be determined using Equation 1 below in which $F_P$ can be a piston force caused by a combustion of fuel and air in a combustion chamber of a cylinder head, and s can be a distance (or stroke) traveled by the piston.

$$W_P=F_P*s \qquad \text{Equation 1}$$

The input work $W_P$ performed by the piston can be used to rotate a crank (or crankshaft). In the case of a rotary mechanical field engine, the crank can be the crank 20' described with reference to FIGS. 14-15, the connector 20 described with reference to FIG. 13, or any other mechanically equivalent mechanism. The work performed by the crank can be an output work $W_C$. The output work $W_C$ can be capable of causing motion in a vehicle, causing motion in an airplane, spinning a blade, and/or performing any other motorized task. The output work $W_C$ can be determined using Equation 2 below in which T can be a torque applied to the crank, and ω can be the angle (in radians) which the crank rotates due to the applied torque T.

$$W_C=T*\omega \qquad \text{Equation 2}$$

In an exemplary embodiment, the torque T applied to the crank can be applied through a connecting rod which is pivotally connected to the piston. The connecting rod can be an actual rod such as the rod 34' illustrated with reference to FIGS. 14-15, the inset disc 34 described with reference to FIG. 13, or any other mechanically equivalent mechanism. The torque can be determined using Equation 3 below in which r can be a length of the crank and $F_T$ can be a component of the piston force $F_P$ which is tangentially applied to the crank.

$$T=r*F_T \qquad \text{Equation 3}$$

Figure 16:
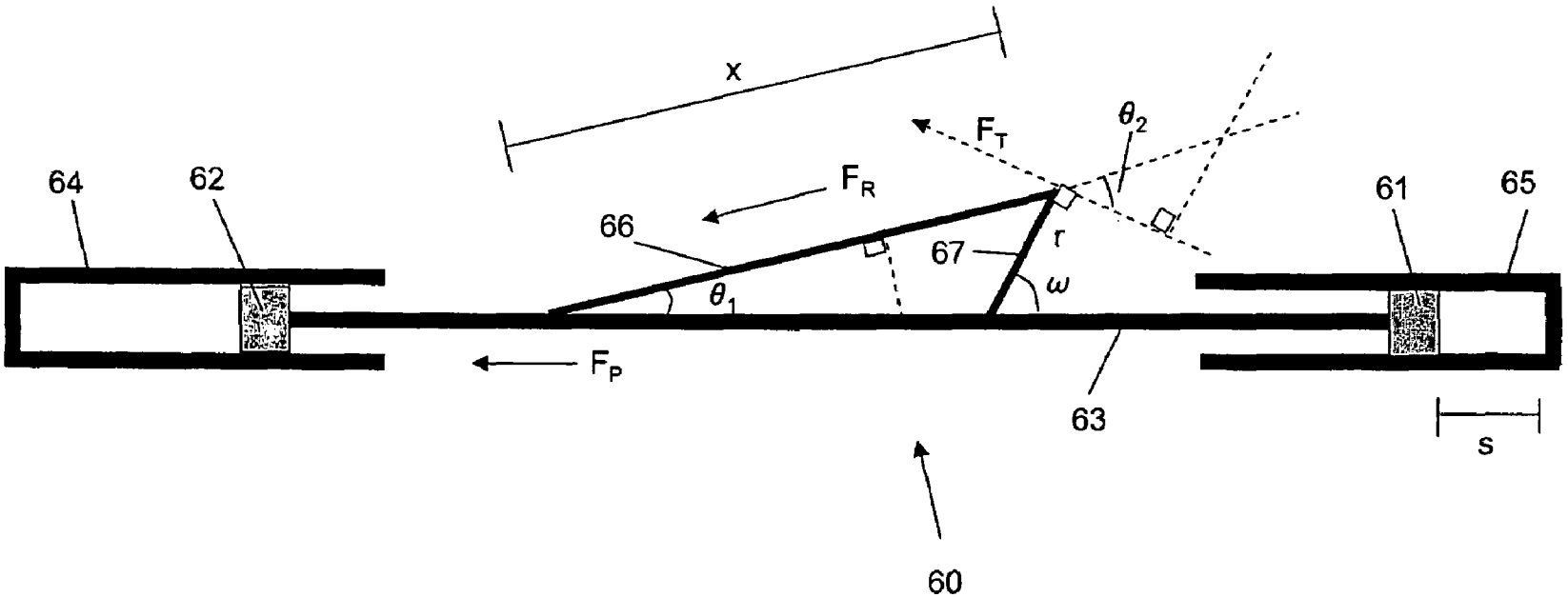
FIG. 16 is a diagram illustrating forces within a rotary mechanical field engine in accordance with an exemplary embodiment.

FIG. 16 is a diagram illustrating forces within a rotary mechanical field engine in accordance with an exemplary embodiment. The rotary mechanical field engine includes a piston 60 which has a right piston head 61, a left piston head 62, and a rigid piston rod 63 connecting the right piston head 61 and the left piston head 62. The left piston head 62 slides within a left cylinder head 64, and the right piston head 61 slides within a right cylinder head 65. A connecting rod 66 of length x is pivotally connected to the rigid piston rod 63, and a crank 67 of length r is pivotally connected to the connecting rod 66. In an exemplary embodiment, the connecting rod 66 can be the inset disc 34 described with reference to FIG. 13. Alternatively, the connecting rod 66 can be any other mechanically equivalent mechanism.

In an exemplary embodiment, a combustion reaction in the right cylinder head 65 can cause the piston 60 to move toward the left with a piston force $F_P$. The piston 60 can pull on the connecting rod 66 with a rod force $F_R$, and the connecting rod 66 can in turn pull on the crank 67 with a tangential force $F_T$. The force $F_R$ can be equal to $F_P*\cos(\theta_1)$, where $\theta_1$ can be an angle between the rigid piston rod 63 and the connecting rod 66. The force $F_T$ can be equal to $F_R*\cos(\theta_2)$, where $\theta_2$ can be an angle between a line extending from the connecting rod 66 and a line perpendicular to the crank 67. An angle ω can be the angle by which the crank 67 has rotated due to the (pulling) piston force $F_P$, and a length s can be a horizontal distance (or stroke) traveled by the piston 60.

Using Equation 1, an input work $W_P$ performed by the piston 60 illustrated with reference to FIG. 16 can be $(F_P)*(s)$. Using Equation 3, a torque T applied to the crank 67 can be $(r)*(F_T)=(r)*[(F_R)*(\cos\ \theta_2)]=(r)*(F_P)*(\cos\ \theta_1)*(\cos\ \theta_2)$. Using Equation 2, an output work $W_C$ performed by the crank 67 can be $(T)*(\omega)=(r)*(F_P)*(\cos\theta_1)*(\cos\theta_2)*(\omega)$. Based on this analysis, it can be seen that the input work $W_P$ performed by the piston 60 is directly proportional to the horizontal distance s traveled by the piston 60, and the output work $W_C$ performed by the crank 67 is directly proportional to the angle ω by which the crank 67 has rotated.

Figure 17A:
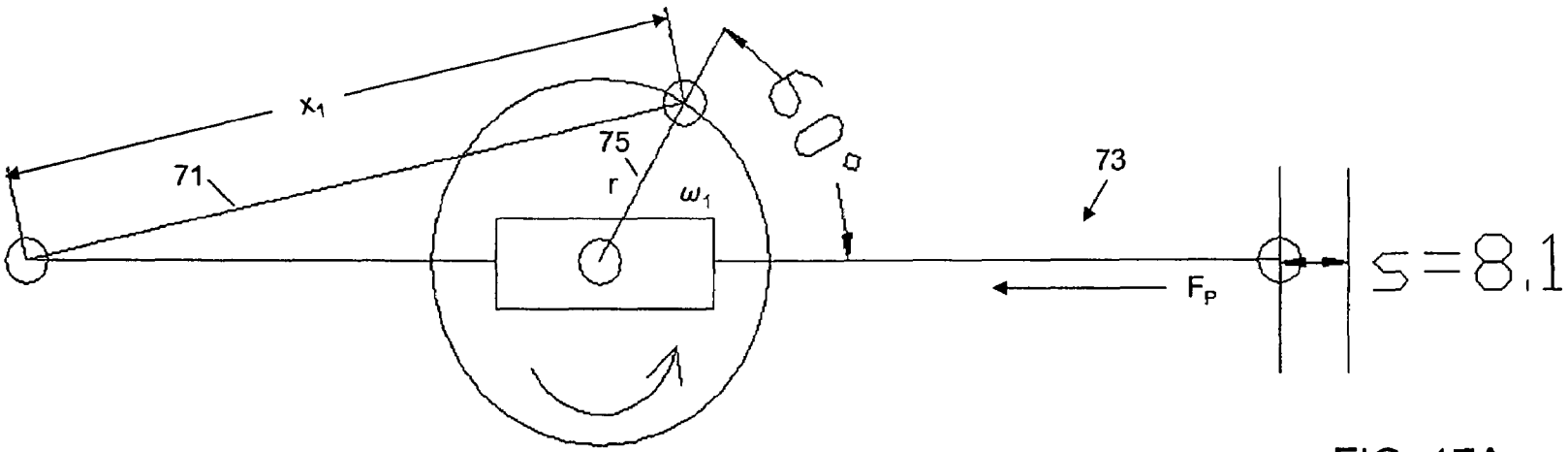
FIG. 17A is a partial engine diagram illustrating a long connecting rod with a length $x_1$ in accordance with an exemplary embodiment.
Figure 17B:
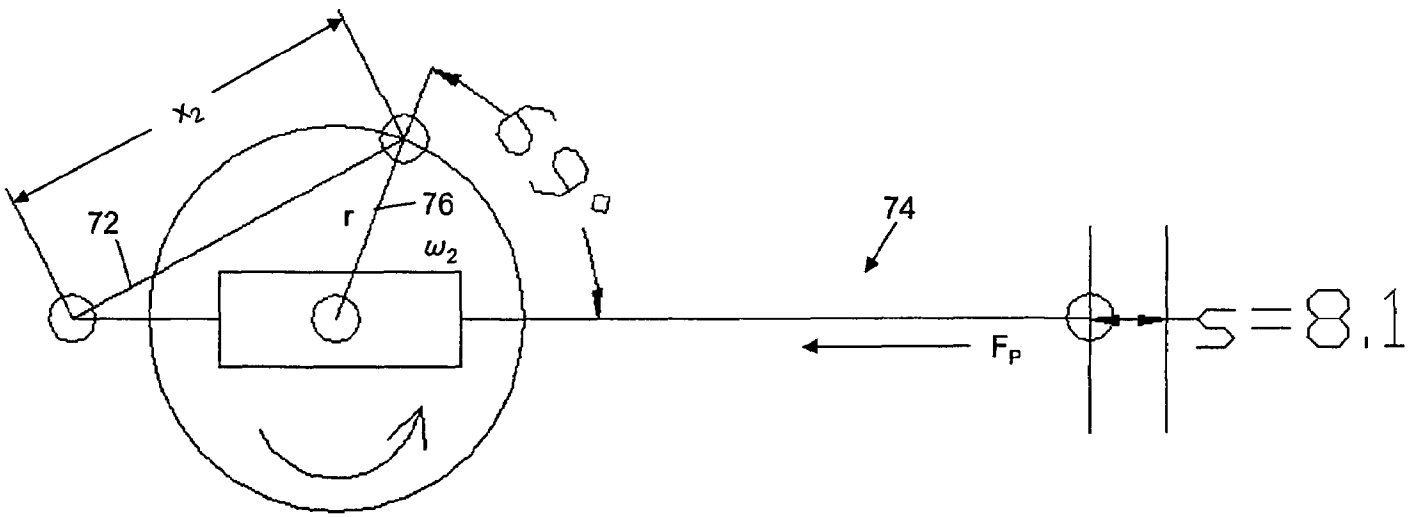
FIG. 17B is a partial engine diagram illustrating a short connecting rod with a length $x_2$ in accordance with an exemplary embodiment.

Using geometry and the laws of physics, it can be shown that the length x of the connecting rod 66 can dictate the angle ω for a given horizontal distance s traveled by the piston 60. In general, a shorter connecting rod corresponds to a larger angle ω of rotation. This property is illustrated with reference to FIGS. 17A and 17B. FIG. 17A is a partial engine diagram illustrating a long connecting rod 71 with a length $x_1$ in accordance with an exemplary embodiment. FIG. 17B is a partial engine diagram illustrating a short connecting rod 72 with a length $x_2$ in accordance with an exemplary embodiment. The length $x_2$ can be less than the length $x_1$. With reference to FIG. 17A, a piston 73 can have a force $F_P$ and travel a horizontal distance s equal to 8.1. The piston 73 can cause the long connecting rod 71 to rotate a crank 75 of length r an angle $\omega_1$ equal to 60°. With reference to FIG. 17B, a piston 74 can have the same force $F_P$ and travel the same horizontal distance s (8.1) as the piston 73 described with reference to FIG. 17A. The piston 74 can cause the short connecting rod 72 to rotate a crank 76 of the same length r an angle $\omega_2$ equal to 69°.

Using Equation 1, the input work $W_P$ performed by the piston 73 and the input work $W_P$ performed by the piston 74 can both be equal to $(F_P)$*(s), or $(F_P)$*(8.1). As described above, the output work $W_C$ performed by a crank can be directly proportional to an angle ω by which the crank has rotated such that a larger value of ω corresponds to a higher output work $W_C$. Thus, even though the piston 73 and the piston 74 have performed the same input work $W_P$, the piston 74 generates more output work $W_C$ at the crank 76 than the piston 73 does at the crank 75. This increased output work $W_C$ is due in part to the decreased length of the short connecting rod 72. Because the crank 76 rotates a greater angle ω than the crank 75, it also follows that, given the same piston velocity, the crank 76 connected to the short connecting rod 72 rotates more rapidly than the crank 75 connected to the long connecting rod 71.

In an exemplary embodiment, any of the rotary mechanical field engines described herein are able to use a significantly shorter connecting rod than can be used in traditional engines. In traditional engines, if the angle between the piston and its connecting rod becomes too large, the connecting rod can apply a sideways force on the piston causing the piston to rub against the cylinder wall. This rubbing, which can cause severe damage to both the piston and the cylinder, can occur because the piston is only anchored through a single point at its single piston head. To prevent this sideways force on the piston, a long connecting rod is used such that the angle between the piston and the connecting rod is minimized. In a rotary mechanical field engine, the piston can have three or more anchor points to stabilize the piston and prevent the piston from rubbing against a cylinder wall due to a sideways force. A first anchor point can be at a piston head on the left side of the piston, a second anchor point can be at a piston head on the right side of the piston, and a third anchor point can be along a rigid piston rod which connects the right and left piston heads. In one embodiment, there can be a plurality of anchor points along the rigid piston rod. As such, a large angle between the piston and its connecting rod is not problematic, and a short connecting rod can be used. As described above, given the same input work $W_P$, a shorter connecting rod can result in an increase in the output work $W_C$ of the engine. As a result, a piston in a rotary mechanical field engine can achieve the same rotational velocity (of a crank) as a piston in a traditional engine while moving at a significantly lower velocity.

Even in the case where a rotary mechanical field engine and a traditional engine have connecting rods of the same length, it can be shown that the unique configuration of the rotary mechanical field engine allows it to generate more output work $W_C$ than the traditional engine given the same input work $W_P$. This can be due in part to the novel way in which the connecting rod force $F_R$ is applied to a crank in the rotary mechanical field engine. In the rotary mechanical field engine, the connecting rod can pull the crank, whereas in a traditional engine, the crank is pushed by the connecting rod. Exemplary differences in configuration between a rotary mechanical field engine and a traditional engine are illustrated with reference to FIGS. 18A and 18B.

Figure 18A:
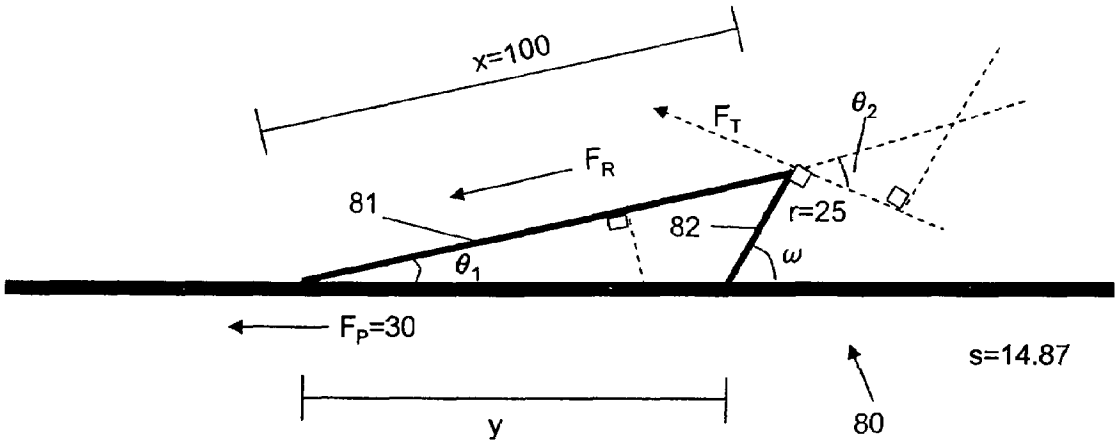
FIG. 18A is a partial engine diagram illustrating a rotary mechanical field engine connecting rod capable of applying a pulling force to a crank in accordance with an exemplary embodiment.
Figure 18B:
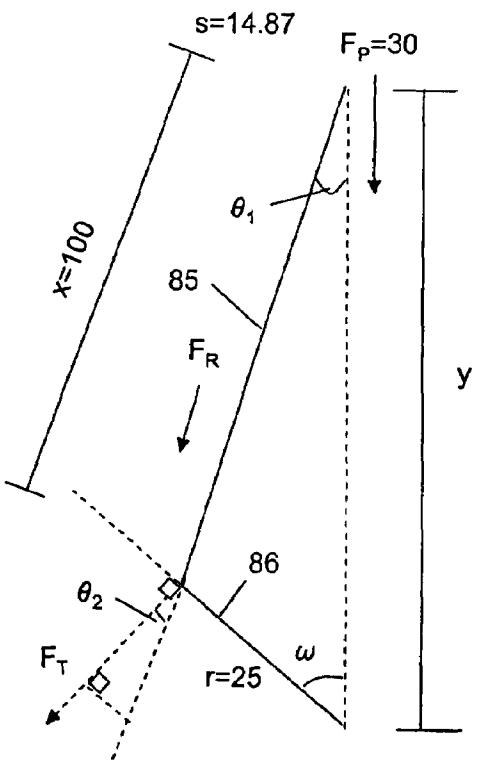
FIG. 18B is a partial engine diagram illustrating a traditional connecting rod in which a crank is pushed.

FIG. 18A is a partial engine diagram illustrating a rotary mechanical field connecting rod 81 capable of applying a pulling force to a crank 82 in accordance with an exemplary embodiment. FIG. 18B is a partial engine diagram illustrating a traditional connecting rod 85 in which a crank 86 is pushed. The connecting rod 81 of the rotary mechanical field engine and the connecting rod 85 of the traditional engine both have a length x equal to 100. The crank 82 of the rotary mechanical field engine and the crank 86 of the traditional engine both have a length x equal to 25. A piston 80 of the rotary mechanical field engine has moved a horizontal distance of s equal to 14.87, and a piston (not shown) of the traditional engine has moved a vertical distance of s equal to 14.87. In addition, both the piston 80 of the rotary mechanical field engine and the piston of the traditional engine have a force $F_P$ equal to 30. As such, the input work $W_P$ of both the rotary mechanical field engine and the traditional engine can be equal to $(F_P)$*(s)=(30)*(14.87)=446.1.

The output work $W_P$ of the traditional engine can be calculated by finding $\theta_1$, $\theta_2$, ω, y, $F_R$, and $F_T$, and using Equations 2 and 3. Based on the vertical distance s traveled by the piston and the length of the connecting rod 85 of the traditional engine, the distance y is found to be 110.13. Using the values of x, y and r, and the law of cosines, the angle ω is found to be 60°. Using ω, r, and x, the angle $\theta_1$ is found to be 12.5°. Using basic geometry, the angle $\theta_2$ is found to be 17.5°. Using the values of $F_P$ and $\theta_1$, $F_R$ is found to be 29.29, and using the values of $F_R$ and $\theta_2$, $F_T$ is found to be 27.93. Using the values of $F_T$ and r, the torque T is found to be 698.31. Using the values of T and ω, the output work $W_P$ generated by the traditional engine is found to be 731.29.

The output work $W_P$ of the rotary mechanical field engine can also be calculated by finding $\theta_1$, $\theta_2$, ω, y, $F_R$, and $F_T$, and using Equations 2 and 3. Based on the horizontal distance s traveled by the piston 80 and the length x of the connecting rod 81, the distance y is found to be 89.87. Using the law of cosines and the law of sines, ω is found to be 73.2°, $\theta_1$ is found to be 13.85°, and $\theta_2$ is found to be 30.65°. Using these values, $F_R$ is found to be 29.13, $F_T$ is found to be 25.06, the torque is found to be 626.47, and the output work $W_C$ is found to be 800.37. Thus, the rotary mechanical field engine's ability to apply a pulling force to the connecting rod 81 instead of a pushing force results in an increase in output work $W_C$ compared to the traditional engine.

Using Equation 2 and Equation 3, it can also be shown that the amount of output work $W_C$ performed by an engine is directly proportional to the length (r) of the engine's crank such that a longer crank results in more output work $W_C$. In traditional engines, lengthening the crank is problematic because it results in an increase in the angle between the piston and its connecting rod. As described above with reference to the connecting rod, this increased angle can cause the piston to rub against the cylinder wall. However, in a rotary mechanical field engine, lengthening the crank is not problematic because of the plurality of anchor points which help stabilize the piston.

Thus, it has been shown that, given an identical input work $W_P$, a rotary mechanical field engine can generate a greater output work $W_C$ than a traditional engine. As a result, to achieve a desired rotational speed of the crank, a piston in the rotary mechanical field engine can move with significantly less velocity than a piston in the traditional engine. This reduction in piston velocity allows a rotary mechanical field engine to achieve an optimal combustion cycle such that engine efficiency is further increased. As an example, a combustion cycle of a four stroke rotary mechanical field engine can include an expansion cycle, an exhaust cycle, a fuel intake cycle, and a compression cycle. In the expansion cycle, because of the reduced piston velocity, the fuel is able to burn under higher pressure and at a higher temperature than in traditional engines. As a result, more inert fuel fractions can be burned, fuel efficiency is increased, and the quality of emissions is increased. In the exhaust cycle, the piston in the rotary mechanical field engine uses less energy to compress and exhaust burnt fuel through a cylinder valve as compared to traditional engines. In addition, there are less undesirable residual hot emission gases remaining in the cylinder after cylinder valve closure in the rotary mechanical field engine. During the fuel intake cycle, the fuel mixture can be better controlled than in traditional engines such that a higher fuel density is achieved. In the compression cycle, the (slower) piston in the rotary mechanical field engine works against a lower force due to less compressed gas. This lower pressure provides enhanced fuel ignition, resulting in a more efficient and effective expansion cycle.

In addition, unlike traditional diesel engines and non-diesel engines, fuel burning in the rotary mechanical field engine is not limited to a single mode of combustion. This property is illustrated with reference to the pressure versus volume diagrams of FIGS. 19A-19C. The pressure and volume in a piston cylinder can be related to one another according to the ideal gas law illustrated with reference to Equation 4 below. In Equation 4, P can be an absolute pressure within a piston cylinder, V can be a volume in the piston cylinder, n can be an amount of gas (in moles) in the piston cylinder, R can be the gas constant, and Temp can be the temperature in Kelvins.

$$P*V=n*R*Temp \qquad \text{Equation 4}$$

Figure 19A:
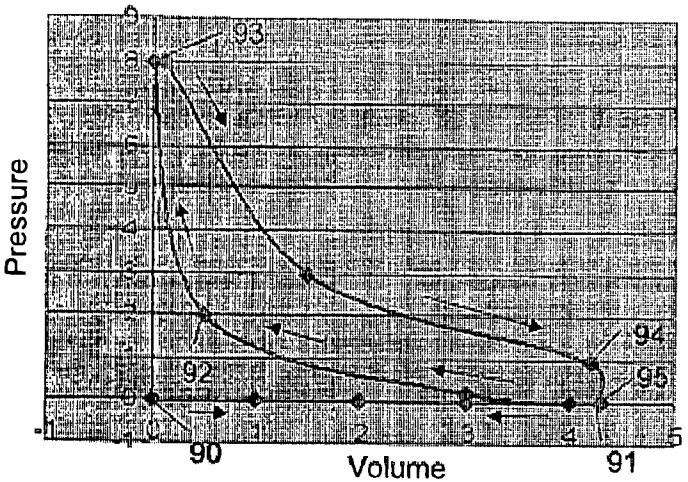
FIG. 19A is a pressure versus volume graph for a traditional non-diesel engine.

In traditional non-diesel (or Otto) engines, the fuel burns due to a steady volume during the combustion cycle. FIG. 19A illustrates a pressure versus volume graph for a traditional Otto (non-diesel) engine. The reference numerals in FIG. 19A correspond to various engine stages which occur in a four stroke Otto engine. At a stage 90, an intake stroke of the Otto engine commences. At the time of the intake stroke, the pressure can be near atmospheric pressure and the gas volume can be at a minimum. During the intake stroke, the piston can be pulled out of the cylinder with the intake valve open. The pressure remains constant, and the gas volume increases as a fuel/air mixture is drawn into the cylinder through an intake valve. At a stage 91, the intake valve is closed and a compression stroke of the Otto engine commences. During the compression stroke, the piston can move back into the cylinder, the gas volume decreases, and the pressure within the cylinder increases. At a stage 92, combustion of the fuel/air mixture occurs. It can be seen that as combustion occurs, the volume remains approximately constant and the pressure increases due to the increase in gas temperature which occurs during the combustion. At a stage 93, a power stroke of the Otto engine commences and the piston is driven towards a crankshaft. During the power stroke, the volume increases and the pressure falls as work is performed on the piston by the compressed gas. At a stage 94, an exhaust valve is opened and residual heat in the gas is exchanged with the surrounding atmosphere. As the exhaust valve is opened, the volume remains constant and the pressure adjusts back to atmospheric conditions. At a stage 95, an exhaust stroke of the Otto engine commences. During the exhaust stroke, the piston moves back into the cylinder, the volume decreases, and the pressure remains constant. At the end of the exhaust stroke, conditions have returned to stage 90, and the stages are repeated.

Figure 19B:
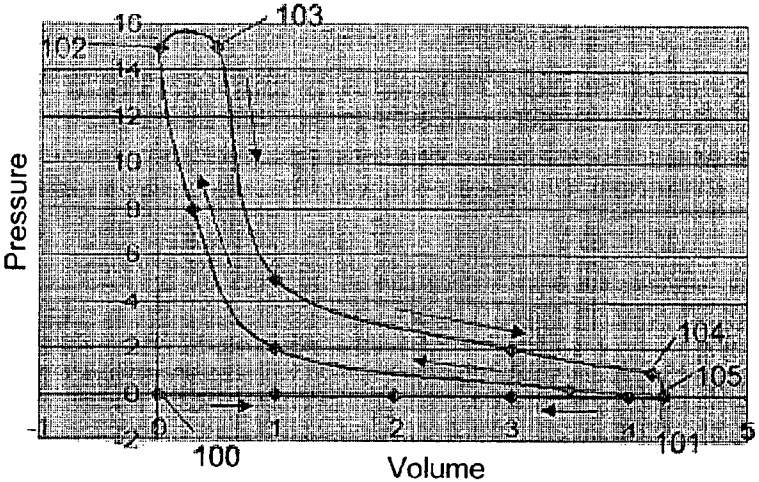
FIG. 19B is a pressure versus volume graph for a traditional diesel engine.

In traditional diesel engines, the fuel burns due to steady pressure applied to the fuel. FIG. 19B illustrates a pressure versus volume graph for a traditional diesel engine. At a stage 100, an intake stroke of the diesel engine commences. At the time of the intake stroke, the pressure can be near atmospheric pressure and the gas volume can be at a minimum. During the intake stroke, the piston can be pulled out of the cylinder with the intake valve open. The pressure remains constant, and the gas volume increases as air is drawn into the cylinder. At a stage 101, a compression stroke of the diesel engine commences. During the compression stroke, the piston can move back into the cylinder, the gas volume decreases, and the pressure within the cylinder increases. At a stage 102, combustion of the compressed air and a fuel can commence and a power stroke can begin. The fuel can be inserted through a fuel valve and can spontaneously combust due to the high gas pressure. It can be seen that as combustion occurs, the volume increases and the pressure remains approximately constant. At a stage 103, the combustion stage is complete, and the power stroke of the diesel engine continues. During the remainder of the power stroke, the volume increases and the pressure falls as work is performed on the piston by the compressed gas. At a stage 104, an exhaust valve is opened and residual heat is exchanged with the surrounding atmosphere. As the exhaust valve is opened, the volume remains constant and the pressure adjusts back to atmospheric conditions. At a stage 105, an exhaust stroke of the diesel engine commences. During the exhaust stroke, the piston moves back into the cylinder, the volume decreases, and the pressure remains constant. At the end of the exhaust stroke, conditions have returned to stage 100, and the stages are repeated.

Figure 19C:
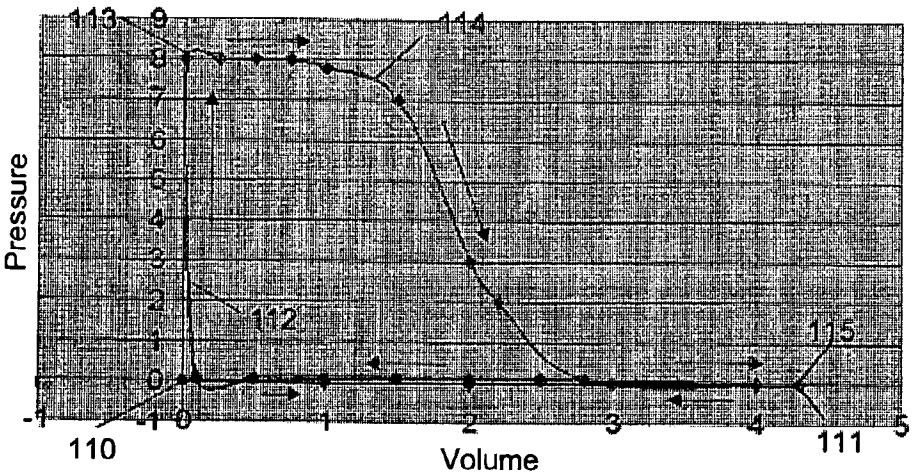
FIG. 19C is a pressure versus volume graph for a rotary mechanical field engine in accordance with an exemplary embodiment.

FIG. 19C illustrates a pressure versus volume graph for a rotary mechanical field engine in accordance with an exemplary embodiment. As shown in FIG. 19C, the above-described optimal combustion cycle allows the fuel in a rotary mechanical field engine to burn by both steady pressure and steady volume, resulting in a mixed combustion cycle engine in which fuel efficiency is optimized and fuel usage is minimized. At a stage 110, an intake stroke of the rotary mechanical field engine can commence. At the time of the intake stroke, the pressure can be near atmospheric pressure and the gas volume can be at a minimum. During the intake stroke, air and fuel can be pulled into the cylinder through one or more intake valves. The pressure can remain constant, and the gas volume can increase as air and fuel are drawn into the cylinder. At a stage 111, a compression stroke of the rotary mechanical field engine can commence. During the compression stroke, the gas volume can decrease. Due to the slower velocity of the piston, the pressure within the cylinder increases at a much slower rate than in traditional engines. As such, the volume is extremely low before the pressure increases noticeably. At a stage 112, combustion of the compressed air/fuel mixture can commence through a spark from a spark plug or other ignition source. During this stage of combustion, it can be seen that the volume remains substantially constant and is similar to combustion in a traditional Otto engine. At a stage 113, a power stroke of the rotary mechanical field engine commences. During this power stroke, combustion of the compressed air/fuel mixture continues over a substantially constant pressure. This second combustion stage is similar to combustion in a traditional diesel engine. At a stage 114, the power stroke can continue, and the pressure can begin to decrease as the combustion is completed. At a stage 115, an exhaust stroke of the rotary mechanical field engine commences. During the exhaust stroke, the volume decreases, and the pressure remains constant. At the end of the exhaust stroke, conditions have returned to stage 110, and the stages are repeated.

Thus, the rotary mechanical field engine is capable of combining steady volume combustion similar to that in a traditional Otto engine and steady pressure combustion similar to that in a traditional diesel engine. As a result, a much higher percentage of the fuel is able to be burned in the rotary mechanical field engine as compared to traditional engines such that the rotary mechanical field engine is more efficient, more powerful, uses less fuel, and creates less harmful emissions. In an exemplary embodiment, the configuration of the rotary mechanical field engine can be adjusted such that the amount of fuel which burns during each of the two combustion stages can be controlled.

A number of other advantages result from the design and operation described with reference to FIGS. 1-19. For example, the design provides balanced movement and uniform speed of rotary elements of different diameters. Further, the design provides an increase in the periods of active movement of constituent parts compared to conventional rotary transmissions. Another advantage is that the speed of the linear movement of the piston is equalized with movement in the opposite direction, enabling the production of engines with high power and high rotational speed, independent of their working volume.

Compared to traditional engines, the engine described herein benefits from a simplified piston assembly, a balanced rotary motion that reduces torsion and vibration, a reduction in the friction in the piston-cylinder assembly, and a reduction in thermal burden. Furthermore, the engine has the advantage of better combustion conditions due to an approximate constant speed of the piston assembly. Other benefits from the construction and design translate into greater efficiency and improved performance.

A number of uses of the engine described are possible. For example, the engine design can be used in a wide variety of engines, compressors, water turbines, gas turbines, jet engines, propellers, hydraulics, and transmission systems. For example, the design described with reference to the Figures can be used in the transmission system of a bicycle. The design can also be utilized to reduce damages from vehicle crashes because the design provides an opposite force to slow the vehicle more easily than conventional designs.

A wide range of adaptations can be made to the design described in the present application. For example, one adaptation can include two pistons positioned at angles to each other. This implementation would have four cylinders providing power, yet it would provide significant improvements over conventional four cylinder engines. Other configurations and variations can also be implemented depending on the needs of the design's use.

In performance tests conducted by the inventors, the design has provided an increase in torque many times greater than conventional systems. A person of skill in the art can represent the forces created in formulaic terms such that the performance advantages of the design described herein can be mathematically compared to known systems.

While several embodiments of the invention have been described, it is to be understood that modifications and changes will occur to those skilled in the art to which the invention pertains. For example, although particular embodiments and implementations described contemplate particular configurations and dimensions, other designs and sizes may also include the functionalities described herein. Moreover, while the exemplary embodiments are described using one piston as an example, multiple pistons can also be used. The invention is not limited to a particular embodiment, but extends to various modifications, combinations, and permutations that nevertheless fall within the scope and spirit of the appended claims.

What is claimed is:

1. A mixed combustion cycle engine comprising:

a first cylinder in which a first cylinder combustion occurs to induce movement of a first piston head in a lateral direction, wherein the first cylinder combustion comprises a first stage during which a first portion of a fuel and air mixture is burned over a substantially constant volume of the fuel and air mixture, and a second stage during which a second portion of the fuel and air mixture is burned over a substantially constant pressure within the first cylinder;

a piston comprising the first piston head and a rigid piston rod mounted to the first piston head;

a connecting rod pivotally mounted to the rigid piston rod and configured to receive a pulling force applied by the piston; and an inset disc pivotally mounted to the connecting rod such that the connecting rod applies a torque for rotating the inset disc.

2. The engine of claim 1, wherein the piston further comprises a second piston head, and further wherein the rigid piston rod is mounted to the second piston head.

3. The engine of claim 1, wherein the connecting rod comprises a connector.

4. The engine of claim 1, wherein the axis is at the center of the inset disc.

5. The engine of claim 1, wherein the inset disc rotates in a first direction, thereby causing a rotary member coupled to the inset disc to rotate in a second direction which is opposite to the first direction.

6. The engine of claim 5, wherein the inset disc is located inside a cutout of the rotary member.

7. The engine of claim 1, further comprising a second cylinder in which a second cylinder combustion occurs to induce movement of a second piston head in a lateral direction, wherein the second cylinder combustion comprises a third stage during which a first portion of a second fuel and air mixture is burned over a substantially constant volume of the fuel and air mixture, and a fourth stage during which a second portion of the second fuel and air mixture is burned over a substantially constant pressure within the first cylinder.

8. The engine of claim 7, further comprising a timing apparatus configured to control the first cylinder combustion and the second cylinder combustion such that the piston moves uniformly back and forth along a lateral path.

9. A method of generating work with a rotary field mechanical engine comprising:

causing a piston head of a piston to perform an intake stroke in a first lateral direction such that a fuel and air mixture is injected into a cylinder in which the piston head moves;

causing the piston head to perform a compression stroke in a second lateral direction which is opposite the first lateral direction such that the injected fuel and air mixture is compressed over a substantially constant pressure within the cylinder; and igniting the compressed fuel and air mixture such that a first combustion reaction and a second combustion reaction occur, wherein the first combustion reaction causes a first portion of the fuel and air mixture to bum while a volume of the fuel and air mixture remains substantially constant, wherein the second combustion reaction causes a second portion of the fuel and air mixture to burn while a pressure within the cylinder remains substantially constant, and further wherein the piston head moves in the first lateral direction during the second combustion reaction;

wherein a connecting rod is pivotally mounted to the piston and configured to receive a pulling force applied by the piston, and further wherein an inset disc is pivotally mounted to the connecting rod such that the connecting rod applies a torque for rotating the inset disc.

10. The method of claim 9, wherein the first combustion occurs subsequent to the compression stroke of the piston head.

11. The method of claim 9, wherein the first combustion occurs during the compression stroke of the piston head.

12. The method of claim 9, further comprising causing the piston head to perform an exhaust stroke in the second lateral direction such that residual gas and heat is removed from the cylinder.

13. The method of claim 9, wherein the piston head is coupled to a rotary member such that lateral movement of the piston is translated into rotational motion of the rotary member.

14. The method of claim 9, wherein the compressed fuel and air is ignited with a spark from a spark plug.

15. An assembly that converts linear motion to rotational motion, the assembly comprising:

a linear component that moves in a first linear direction when acted upon by a first force and in a second linear direction when acted upon by a second force, the first linear direction being opposite to the second linear direction; and a rotary component that moves in a rotary direction when the linear component moves, the rotary component including an offset rotary element rotatable connected to the rotary component, wherein the offset rotary element is located in a recessed section of the rotary component, and further wherein the offset rotary element is coupled to the linear component by a fixed connection and a moveable connection, wherein the moveable connection to the linear component is contained in an aperture in the linear component and moves within the aperture in the linear component as to cause the offset rotary element and the rotary component to move in a continuous rotary direction despite a change in direction by the linear component from the first linear direction to the second linear direction.

16. The assembly of claim 15, wherein the offset rotary element and the rotary component rotate in opposite directions.

17. The assembly of claim 15, wherein the moveable connection includes an axle coupled to the offset rotary element and a crossbar located in and moveable throughout the aperture in the linear component, wherein the crossbar is not located along the same axis as the axle.

18. The assembly of claim 15, wherein the offset rotary element is rotatable coupled to the surface of the rotary component.

* * * * *